United States Patent [19]

Williams

[11] 4,361,371

[45] Nov. 30, 1982

[54] PACKAGING OF SOLID STATE RELAY

[75] Inventor: Charles N. Williams, Princeton, Ind.

[73] Assignee: AMF Incorporated, White Plains, N.Y.

[21] Appl. No.: 213,775

[22] Filed: Dec. 8, 1980

[51] Int. Cl.[3] ..... H01R 9/09; H01R 9/18

[52] U.S. Cl. ..... 339/17 R; 339/198 R; 339/220 R; 361/399

[58] Field of Search ..... 339/17 R, 17 C, 17 N, 339/17 LC, 220 R, 221 R, 221 M, 198 R; 361/392–395, 399, 415; 29/842, 843, 844

[56] References Cited

U.S. PATENT DOCUMENTS

| | | | |
|---|---|---|---|
| 2,762,030 | 9/1956 | Scoville | 339/277 R |
| 3,445,803 | 5/1969 | Johnston et al. | 339/17 R |
| 3,723,950 | 3/1973 | Lovrenich | 339/220 R |
| 3,980,367 | 9/1976 | Laserson | 339/17 R |
| 4,040,700 | 8/1977 | Obuch | 339/258 S |
| 4,159,505 | 6/1979 | Carp et al. | 361/399 |

FOREIGN PATENT DOCUMENTS

| | | | |
|---|---|---|---|
| 2409660 | 9/1975 | Fed. Rep. of Germany | 361/399 |
| 2221829 | 10/1974 | France | 339/221 R |

*Primary Examiner*—Neil Abrams

*Attorney, Agent, or Firm*—David E. Dougherty; Charles J. Worth

[57] ABSTRACT

An electrically conductive terminal having barbed portions on one end thereof, and a split pig-tail portion on the opposite end thereof. The barbed terminal end is force fitted into an aperture in a plastic housing of the solid state relay. The pig-tail portion extends downwardly into the interior space of the housing and a printed circuit board is inserted over the pig-tail. The pig-tailed terminal end is then spread to hold the printed circuit board within the package.

6 Claims, 3 Drawing Figures

PACKAGING OF SOLID STATE RELAY

BACKGROUND OF THE INVENTION

This invention relates to a solid state relay package comprised of a printed circuit board mounted within a housing and, more particularly, to terminal means for providing a mechanical connection to the housing and the printed circuit board.

Solid state relays are well known. Some commonly used circuits for such relays are described in U.S. Pat. Nos. 3,555,353 issued Jan. 12, 1971 to Charles F. Casson and 3,723,769 issued Mar. 27, 1973 to Howard W. Collins. Such devices typically use a semiconductor switching device which can be switched into conduction by a control signal. These semiconductor switching devices are commonly mounted on a printed circuit board which is suspended in an insulation mass or housing.

In previous constructions, the terminal assembly has been attached to printed circuit boards simply by holding the printed circuit board in place via a jig setup and soldering the terminal thereto. The other end of the terminal was commonly affixed to the relay housing by means of a rivet or screw component. This, in the prior art, served to provide connection between the housing and the external terminal connector end. Although this type of terminal connection and packaging is in common use, its construction has been found to have many shortcomings. Some such shortcomings are the need for a jig setup during manufacture, a lack of a mechanical connection between the printed circuit board and the terminal and the housing, and the complexity of the mounting techniques employed to affix the terminal(s) to the housing.

PRIOR ART STATEMENT

In one prior art device, such as is described in U.S. Pat. No. 4,011,398 issued Mar. 8, 1977 to Douglas B. Muny et al. terminals having pointing engaging faces 46 are located within a respective positioning slot of a subassembly 30. An ultrasonic welder is applied to the terminal assembly causing it to liquify and form around the pointed engaging faces of the terminals to affix same to the terminal assembly.

Another prior art terminal contact is described in U.S. Pat. No. 3,601,752 issued Aug. 24, 1971 to William Vito Pauza. The terminal disclosed has provision for staking connection to a circuit board and an upstanding terminal for mating engagement with a terminated conductor.

Other prior art patents of interest include: U.S. Pat. Nos. 2,538,070 issued January 1951 to Wright et al; 2,811,702 issued October 1957 to Narozny; 3,524,240 issued August 1970 to Walker et al; 3,601,752 issued August 1971 to Panza; 3,989,345 issued November 1976 to DeVito; 2,264,405 issued December 1941 to Poitras; 3,077,023 issued February 1963 to Johnson; 3,162,788 issued December 1964 to Allen et al; 2,170,472 issued August 1939 to Fitch and 3,876,926 issued April 1975 to Schott et al.

The above patents are mentioned as being representative of the prior art and other pertinent references may exist. None of the above noted patents are deemed to affect the patentability of the present claimed invention.

In contrast to the prior art, the present invention provides a method and apparatus for establishing a relatively inexpensive terminal which provides a mechanical connection between a printed circuit board and the housing of a solid state relay. The terminal has two downwardly projecting terminal ends each adapted to affix either to the printed circuit, by means of a pig-tail portion, or the housing, by means of a barbed portion which is force fitted into a slot in the housing. The terminal enables mounting of the printed circuit board prior to soldering, is adapted for ease of assembly of the relay package and involves a minimum of associated parts.

SUMMARY OF THE INVENTION

An electrical terminal for mounting a circuit board to the casing of a solid state relay device comprising:

A generally flat base member having a first end portion extending therefrom in a plane substantially normal to said first plane and having a barb means for being force fitted into a slot in the casing to engage the walls of the slot to provide a mechanical securing connection thereto, said base member having a second end portion extending therefrom and having a bifurcated portion extending in a generally parallel plane with said first end portion and adapted for being inset into a receiving portion of the circuit board to form a mechanical mounting connection for the circuit board with the casing of the solid state relay device.

Accordingly, it is an object of the invention to provide a simple and inexpensive terminal for facilitating assembly of a printed circuit board into a housing of a solid state relay.

It is a further object of the invention to provide an inexpensive means of mechanically attaching a terminal contact to both a housing and a circuit board.

It is a still further object of the invention to provide a packaging method to facilitate assembly of solid state relays.

It is another object of the invention to provide a manufacturing technique to simply and inexpensively mount a printed circuit board in a solid state relay casing to facilitate terminal-to-circuit soldering connection while obviating any need for a jig setup operation to effect same.

BRIEF DESCRIPTION OF THE DRAWINGS

Other objects and advantages of the invention may be more clearly seen when viewed in conjunction with the accompanying drawings. Similar reference numerals refer to similar parts throughout.

DETAILED DESCRIPTION OF THE INVENTION

Figure 1:
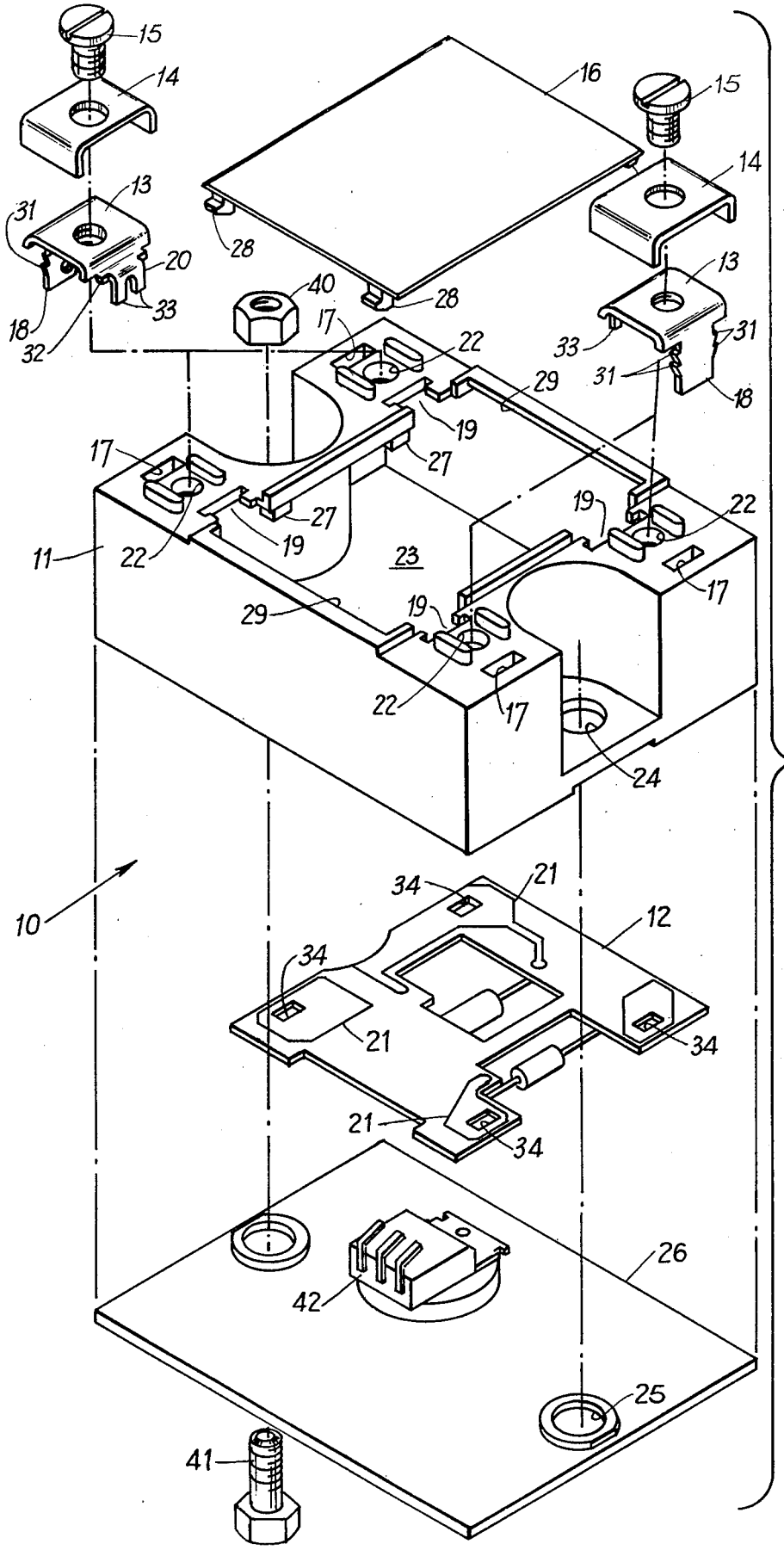
FIG. 1 is an exploded view of the solid state relay package in accordance with the present invention.
Figure 2:
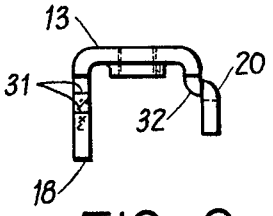
FIG. 2 is a side view of the terminal shown in FIG. 1.
Figure 3:
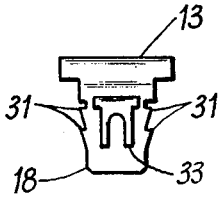
FIG. 3 is an end view of the terminal shown in FIGS. 1 and 2.

As is illustrated in FIG. 1, the relay package, indicated generally by reference numeral 10, is comprised of: a cover or case member 11, a printed circuit board 12, a base plate 26, four terminals 13 (only two shown) each having a terminal cap 14 and terminal screw 15 associated therewith, and a top cover 16.

The case member 11 is formed of a plastic material such as nylon type 30–33% glass fiber re-inforced plastic, and is provided with terminal mounting holes or slots 17. The terminal mounting slots 17 are in a spaced relationship, for example, at each corner of the case member 11, for receiving a barbed end portion 18 of terminal 13. A window 23 is provided at the top of case 11 to facilitate access to the terminal board 12. A terminal screw receiving hole 22 is provided adjacent each slot 17 for receiving a terminal screw therein. Positioning cut-outs 19 are located to receive a terminal end portion 20 and provide access to a respective metal pad 21 on the circuit board 12. A mounting hole 24 is provided on opposing sides of the case 11 and adapted to align with screw holes 25 in the base plate 26. An integral ridge or standoff 27 may also be provided to space the printed circuit board 12 off the under-surface of the case 11 to facilitate potting. The top cover 16 is provided with tabs 28 which engage integral ridges 29 to locate the cover in place on the case 11.

The terminal 13 may be formed of a soft cartridge brass such as ASTM B-36 alloy 260. The terminals each comprise a flat base member or portion lying in a plane generally parallel to the top surface of the case 11. The opposite ends 18 and 20 of the terminal 13 are bent downwardly. Terminal end 18 contains a plurality of barbs or ridges 31 and is dimensioned to be force fitted into a respective slot 17. The barbs 31 are contoured to bite the walls of the slot 17 and thereby provide a mechanical connection between the case 11 and a terminal 13. The other terminal end portion 20 contains a generally sloping or serpentine section 32 which fits within the cut-out section 19 of the case 11, and a downwardly extending portion having a split pig-tail or bifurcated end 33. The split pig-tail ends 33 are contoured to be inserted into a respective slot 34 in the printed circuit board 12, whereupon the bifurcated end is bent to engage the sides of the slot 34. In this manner, the printed circuit board 12 is mounted within the case 11 by means of the mechanical connection between the bifurcated end portion 33 of each terminal 13 and a respective slot 34 in the circuit board 12. With the circuit board mounted by means of the mechanical connections between the bifurcated ends of the terminals 13 and circuit board slots 34, the required solder connections between the terminals 13 and a respective circuit pad 21 is effected without the need for any costly jig operation to hold the components in position during the solder-flow period. In this manner, the integrity of the solder connection is facilitated due to the mechanical holding between the terminals 13 and the circuit board 12.

The metallic base plate 26 is attached to the relay case 11, for example, by means of a nut 40 and bolt 41 through the mounting hole 24 and aligned holes 25 in the base plate 26. Alternately an eyelet (rivet like member) may be used instead of the nut and bolt arrangement to affix the base plate 26 to the case 11. The base plate 26 may have a power transistor or main semiconductor switching device 42 element bonded thereto and serves as a heat sink for the relay unit.

The printed circuit board 12 includes a plurality of electronic components soldered to a series of printed metal runs provided on the surface of a ceramic substrate to form a solid state relay circuit, for example, as is described in U.S. Pat. Nos. 3,555,353 issued Jan. 12, 1971 to Charles F. Casson and 4,172,272 issued Oct. 23, 1979 to Stanley Schnieder.

A potting material may be poured into the housing 11 to a level whereby the circuit board 12 and terminal pads 21 are encapsulated. The interface between the baseplate 26 and case 11 should be sealed before potting (for example with Dow Corning 738 RTV).

The top cover 16 is then snapped, by means of tabs 28 and ridges 29, onto the casing 11 to form an enclosed packaged solid state relay.

While a preferred embodiment of the invention has been disclosed, many variations thereof are possible, for example, the terminal being contoured to have a generally inverted U-shape, all of which are within the true spirit and scope of the invention.

I claim:

1. A dual function electrical terminal connector and mounting bracket for a solid state relay package, in combination comprising:

a housing having side wall means, a top member having a plurality of slot means and an opening extending into the interior of the housing, and a bottom plate member;

a solid state relay circuit board having a plurality of slot means;

a plurality of electrical terminal connectors each having a flat base member disposed on said top member whereby each said base member having a first end portion with barb means force fitted into a respective slot means of the housing for providing a securing connection therebetween, a second end portion extending through said opening into the interior space of said housing and having a serpentine shaped pig-tail means extending through a respective slot means in said relay circuit board and being deformable for engaging said board providing a securing connection therebetween and a threaded attachment means located between said first and second ends;

whereby each terminal connector provides a mechanical connection between the housing and said relay circuit board.

2. A device as in claim 1, wherein:

the opening is dimensioned to form a window to facilitate potting and/or soldering of said second end portion to a terminal pad on said relay circuit board.

3. A device as in claim 1, wherein:

the housing has eyelet means for receiving a securing member to affix the bottom plate member to said housing.

4. A device as in claim 1, wherein:

the solid state relay circuit contains a semiconductor switching device and a control circuit therefore.

5. A dual function electrical terminal connector as in claim 1, wherein:

the flat base member has a threaded hole for receiving a bolt therein, the second end portion includes a sloping portion intermediate said flat base member and the pig-tail means, and said first end portion and the pig-tail means generally lie in parallel planes each substantially normal to the plane of said flat base member.

6. A device as in claim 1, wherein:

the solid state relay package contains four said electrical terminal connectors consisting of two input and two output terminal connectors each positioned generally on and about a top corner surface of the top member of the housing.

* * * * *